United States Patent [19]

Connors

[11] 4,097,019

[45] Jun. 27, 1978

[54] INGOT MOLD BASE MEMBER

[75] Inventor: Charles W. Connors, Wilmette, Ill.

[73] Assignee: Nalco Chemical Company, Oak Brook, Ill.

[21] Appl. No.: 664,725

[22] Filed: Mar. 8, 1976

[51] Int. Cl.[2] ..... B22D 7/12; B22D 19/00; C04B 35/10

[52] U.S. Cl. ..... 249/204; 106/38.3; 164/98; 164/111

[58] Field of Search ..... 249/204, 174, 106; 164/332, 412, 97, 98, 111, 112; 106/38.3, 38.35; 264/35

[56] References Cited

U.S. PATENT DOCUMENTS

| | | | |
|---|---|---|---|
| 433,587 | 8/1890 | Adams | 249/204 |
| 1,335,685 | 3/1920 | Howard et al. | 249/174 UX |
| 2,280,906 | 4/1942 | Felsing | 249/204 |
| 2,444,140 | 6/1948 | Messler | 249/204 |
| 2,504,133 | 4/1950 | Kerlin | 106/38.5 R |
| 3,385,346 | 5/1968 | Fleck | 249/204 X |
| 3,514,069 | 5/1970 | Daley | 249/174 X |
| 3,783,933 | 1/1974 | Leedy | 249/204 X |
| 3,860,476 | 1/1975 | Moore | 106/38.3 X |
| 3,870,529 | 3/1975 | Okumoto | 106/38.3 |
| 3,874,628 | 4/1975 | Jarron | 249/204 |
| 3,918,624 | 11/1975 | Kurihara | 164/6 X |
| 3,920,460 | 11/1975 | Boston | 106/38.3 |
| 3,923,525 | 12/1975 | Toeniskoetter | 106/38.3 |

FOREIGN PATENT DOCUMENTS

| | | | |
|---|---|---|---|
| 600,898 | 12/1959 | Italy | 249/204 |

*Primary Examiner*—Francis S. Husar
*Assistant Examiner*—John S. Brown
*Attorney, Agent, or Firm*—John G. Premo; Robert A. Miller; Barry W. Sufrin

[57] ABSTRACT

A cast iron ingot mold base member containing an integral refractory insert which has been formed into the base member during its casting.

6 Claims, 2 Drawing Figures

INGOT MOLD BASE MEMBER

BACKGROUND OF THE INVENTION

1. Field of the Invention

All metal ingots are cast from molds. These molds rest on bases commonly known as "stools." The stools are large, normally rectangular, flat slabs of metal usually made of cast iron. The stools are used as support for the mold sides and also to form the bottom portion of the mold. In a "big end down" type of mold, the mold sides generally taper down in diameter from bottom to top. In another type of mold, known as the "big end up" mold, there is a ladle-like receiver for the molten metal, the bottom portion of which is an integral non-removal of the entire mold.

Various problems commonly occur in use of these molds and particularly with respect to the surface of their base portions. The unprotected metal surface of the base portion quickly erodes and pits in the presence of molten metal which is cascaded upon its surface. Large gouges in the base portions are produced due to the force and high temperature developed by the flowing molten metal which contacts the surface of the stool.

Since many molds are generally 5–10 feet in height, the metal must be poured from a height at least equal to that distance and quite often is poured from even greater heights. A considerable pressure head is thereby developed. Thus, the hot molten metal easily gouges gaping depressions in the base members under such force and at a temperature of at least the liquefaction temperature of the molten metal. Moreover, the problem of creation of pits or gouges in the base portions of the molds, caused by the above factors, is aggravated due to the fact that the molten metal, especially near the bottom of the mold, remains in its erosive hot liquid state for a considerable amount of time subsequent to pouring.

The molten metal, after solidification to an ingot has a bottom form conforming to the undesirable eroded surface configuration of the stool or base member of the mold. Thus, a considerable amount of the ingot, when withdrawn from the mold and subsequently processed into slabs or blooms, is lost through a cropping of the irregularly formed end of the slab. This, of course, is highly undesirable, since it results in undue loss of usable metal and an increase in scrap which must be subsequently reprocessed.

Another extemely serious and costly problem arises after the ingot in the mold has solidified to a point where it can be removed from both the mold sides and its base platform member or stool. If the surface of the stool is unprotected or inadequately protected and erosion occurs as described above, the ingot has a greater tendency to remain tightly adherent to the stool. Thus, after the mold sides are removed from around the ingot, which process can normally be efficiently achieved with a minimal film of coating selected from a variety of coating agents, the ingot must be forcibly removed from the stool.

Removal is normally achieved by raising both ingot and adherent stool, and thrusting them against some other larger object whereby the ingot is jarred loose. In many cases the stool and ingot are merely dropped on the floor from some suitable height. In such a situation, the stool is often broken into two or more smaller pieces and cannot be subsequently reused in casting other ingots, Again, replacement cost of these stools is high, making this aspect of the overall casting process somewhat disadvantageous. The same problem exists with respect to big end up molds wherein sticking of ingots particularly occurs at their base portion. New molds of this type are especially vulnerable to sticking due to their smooth surface unprotected by any layers of metal oxides or scale: A tight metal-to-metal bond between mold bottoms and ingots may occur in this situation.

Cracking of molds and particularly cracking of their base portions due to the above discussed rough handling occasioned by "stickers" between the base portions and ingots is enhanced by thermal shock during ingot formation. Unprotected or inadequately protected bottom surfaces of molds are especially susceptible to such destructive shock.

2. Description of the Prior Art

Many ways of alleviating the above described problems in connection with the erosion of base members of ingot molds have been proposed in the prior art. A number of refractory coatings have been suggested but these are not entirely satisfactory.

An early solution to the erosion of ingot mold stools resided in the suggestion that refractory inserts could be placed into the bottom of the mold, which refractory would tend to minimize erosion.

However, ceramic inserts have not met with any degree of commercial success. An important drawback of the ceramic inserts relates to the difficulty of anchoring them to the stools. Molten metal tends to work its way into the space between the insert and the stool due to capillary action. In the absence of a sufficient anchoring system, this molten metal tends to force the ceramic insert from its cavity. When this occurs, the ceramic insert positions itself above the top surface of the stool and tends to become entrained within the metal ingot. This entrainment causes a number of problems including the formation of metal inclusions in the ingot which necessitate an expensive operation known as butt cropping.

Another important drawback in the use of ceramic inserts relates to the general inconvenience and the very significant labor expense associated with anchoring — and where applicable — removing the inserts.

OBJECTS OF THE INVENTION

It is an object of the present invention to provide an ingot mold base member which contains a refractory insert in its face. Another object of the present invention is to produce such an ingot mold base member wherein the refractory insert is integral to the base member.

Another object of the present invention is to provide a method of obtaining an ingot mold base member with refractory insert in its face which is free of the difficulties and inconveniences formerly experienced in anchoring such refractory inserts.

Another object of the present invention is to provide an ingot mold base member with refractory insert where the life of the base member may be extended after exhaustion of the insert by replacing said insert.

Another object of the present invention is to provide a practical method for casting metal ingots upon an ingot mold base member utilizing in its face an integral refractory insert.

Other objects will appear hereinafter.

BRIEF SUMMARY OF THE INVENTION

The present invention comprises an improved ingot mold base member, or stool. This ingot mold base member contains an integral refractory insert located in its face.

As will be apparent from the detailed description herein, this ingot mold base member differs from currently used ingot mold base members containing refractory inserts in that the present mold base member contains an integral refractory insert. The present invention thus avoids problems associated with anchoring non-integral refractory inserts. Since the ingot mold base member of this invention is formed by placing a refractory insert upon the bottom of the casting mold and then casting the ingot mold base member about the refractory, the inconvenience and expense associated with anchoring non-integral refractory inserts is eliminated. The ingot mold base members of the present invention may be discarded, remelted and recast or, the refractory insert may be removed from the ingot mold base members and a new insert anchored in its place.

Figure 1:
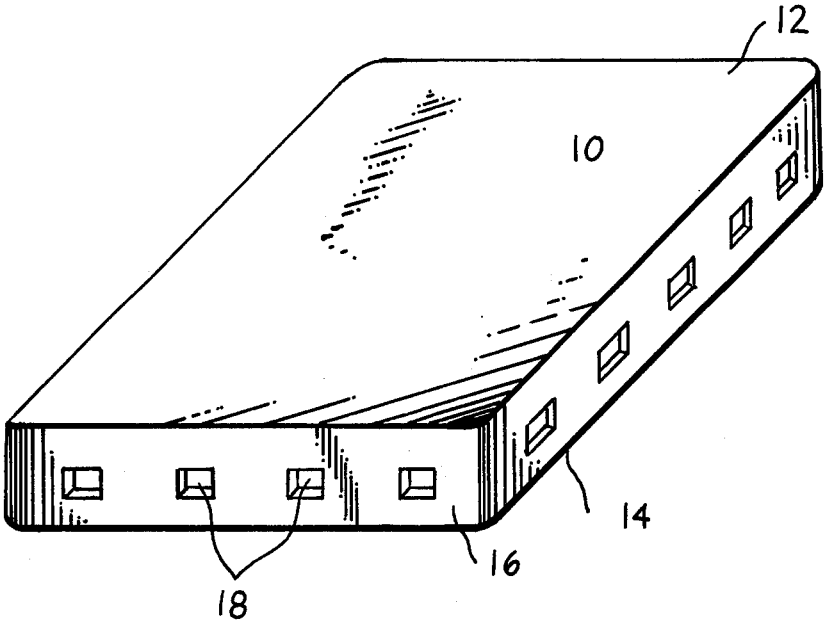
FIG. 1 is an isometric view of a refractory insert.
Figure 2:
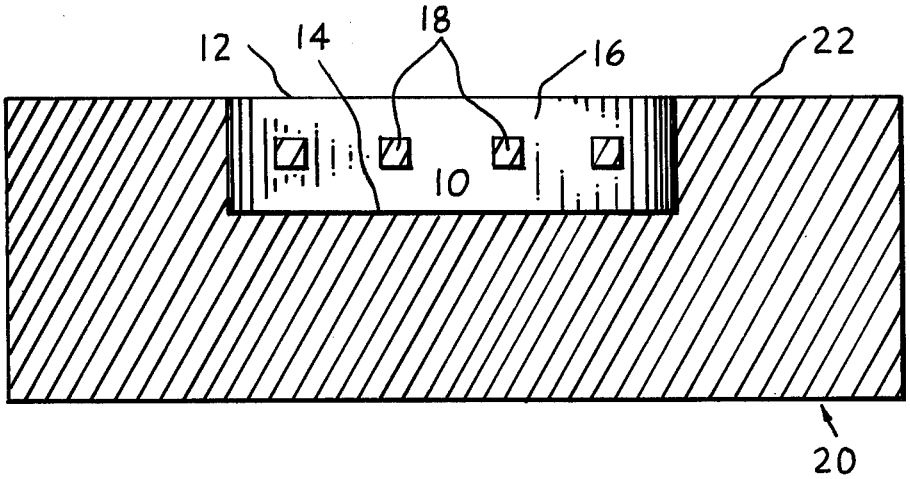
FIG. 2 is a vertical broken away view of a cast iron mold base member containing an integral refractory insert.

With more specific reference to the drawings wherein like parts have like numbers, there is shown a refractory insert 10 of substantially rectangular dimension, with top 12, bottom 14 and side 16 running along its entire perimeter. Refractory insert 10 contains a number of mortise-like openings 18 in its side 16 located approximately midway between bottom of the insert 14 and top of the insert 12.

The base member of the ingot mold, referred to herein as stool 20, has a top surface 22. The refractory insert 10 is located in the stool 20 with its top face 12 substantially flush with the top surface 22 of the stool 20. As discussed further herein, the stool 20 is formed by placing the refractory insert 10 in a casting mold and adding molten cast iron to the mold to form the stool 20 with the integral refractory insert 10. Thus, the mortise-like openings 18 in the refractory insert 10 are filled with the cast iron of the stool 20 to achieve a mortise-and-tenon-like anchoring of the refractory insert 10.

SUMMARY OF THE INVENTION

Formation of the Ingot Mold Base Member

The ingot mold base member of the present invention may be formed by:

(1) placing a refractory insert upon the bottom face of a casting mold;

(2) introducing molten iron into the casting mold;

(3) allowing the molten iron to cool; and, (4) removing the finished ingot mold base member.

The various methods available or apparent to those skilled in the art for forming conventional cast iron ingot mold base members may be employed in the practice of the present invention.

When the above-described casting method is followed, any of a number of available means may be employed to insure that the refractory insert is positioned with its face substantially flush with the face of the ingot mold base member. For example, the refractory insert may be placed face down upon the bottom of a compacted sand mold and held in place by a cope seal which is coated upon the face of the refractory insert. A typical cope seal would be a graphitic grease. The cope seal prevents the refractory insert, which is less dense than the cast iron, from floating away from the bottom of the mold when the molten iron is introduced into the mold. An alternate casting method might entail supporting the refractory insert in the casting mold so that its face is flush with the top of the mold and then introducing the molten iron so that it fills the space below into the sides of the refractory insert.

The Refractory Insert

The refractory insert may be any of a number of geometric shapes including oval, circular and rectangular. It is preferable that the faces of the insert be parallel and that the side of the insert be perpendicular to the parallel faces resulting in a shape which we term "parallel face geometric."

Generally, the refractory insert will be at least 4 inches thick and preferably it will be at least 6 inches thick. Common rectangular insert sizes are 45 inches × 30 inches × 6 inches, 24 inches × 40 × 6 inches and 14 inches × 20 inches × 5 inches. The ingot mold base member will generally be at least 8 inches thick and may range up to 18 inches or more in thickness.

In the simplest embodiment the refractory insert will be of parallel-face geometric shape with planar sides. However, preferably the refractory insert will contain mortise-like openings in its side. The mortise-like openings will be located approximately midway between the top face and the bottom of the insert and typically will be at least $\frac{3}{4}$ inch high × $\frac{1}{2}$ inch deep × 2 inches wide and spaced at approximately 5 inch intervals about the perimeter of the insert. In a preferred embodiment, the sides of the openings will be canted outward to facilitate removal of worn inserts. It is also possible to use various groove configurations.

The refractory insert is formed from many common refractory materials although preferably the refractory material will be composed predominantly of alumina, a binder and filler materials including vitreous silica, crystalline silica, magnesium silicate, aluminum silicate, graphite, zirconium silicate and clay. The preferred refractory material should contain 40–95% alumina, 5–20% binder and the remainder filler.

Typical binders include a mixture of water and one or more of ethyl silicate, sodium silicate, aluminum phosphate, colloidal silica or clay, where water comprises up to 50% by weight of the binder. In a most preferred embodiment, the refractory insert will be formed from a refractory mixture containing at least 70% by weight alumina, 10% by weight ethyl silicate, 10% by weight water and the remainder crystalline silica. Another, a less desirable insert could be formed from about 50% silicon carbide, about 20% silica, about 10% alumina and the remainder binder.

According to the practice of the present invention, the refractory insert will be formed by mixing the materials described above, forming them into a parallel face geometric shape and subjecting them to heating. The temperature and length of heating will depend upon the refractories and the binders used. In a preferred mixture containing 70% alumina, 10% binder, 10% water and the remainder silica, the mixture should be shaped and then subjected to 2500°–3000° F for at least one hour and preferably for three hours or more before use.

REPLACEMENT OF THE REFRACTORY INSERT

Due to the very significant improvement in the ingot mold base member life achieved through the use of the refractory insert, it will probably be economical to merely discard the mold base member after the refractory insert is worn. However, it will also be possible to remove worn refractory inserts by, for example, chipping away at the remaining refractory material with a pneumatic chisel or some other cutting tool. When the above described mortise-like opening design is employed, tenon-like formations will remain in the sides of the insert cavity after removal of the refractory insert. Thus, it will be possible to fill the insert cavity with a plastic refractory composition whereby the tenon-like formations will act as anchors. (See U.S. Pat. No. 3,874,628.)

EXAMPLES

An ingot mold base member may be prepared with a refractory insert of dimension 24 × 36 × 6 inches. This base member may then be compared to an ingot mold base member of similar dimension which does not contain a refractory insert by repeatedly casting molten iron into big end down molds placed upon the top surface of the base members. When molten steel at 2500° F is repeatedly teamed onto the base members from a height of 5 feet, it will be found that the base member without insert will be damaged beyond further use after the formation of 20 ingots whereas the base member containing insert will still be useable (at least ½ inch of refractory material remaining at its thinnest portion) after the formation of 70 ingots.

CONCLUSION

The present invention constitutes an important contribution to the art. It enables those skilled in the art to significantly extend the life of ingot mold base members without the inconvenience and wasted labor associated with emplacing refractory inserts according to presently known methods.

Stools structured as described above, may be used for casting without further preparation. It is preferred, however, to coat the entire surface of the stool with a thin coating of a refractory composition commonly referred to as a "stool coating." This stool coating forms an insulating hard layer on the top surface of the stool which prevents sticking of ingots. Stool coatings are well known in the art and are described, for example, in U.S. Pat. Nos. 3,184,813 and 3,184,815 which are hereby incorporated by reference.

Stools fitted with refractory inserts and generally treated according to the method of the present invention may be used for casting metal with a minimum of pitting and a minimum of difficulties in separating the mold from the stool. Stool life is significantly extended and damaged inserts may be replaced when they become objectionably pitted, cracked or broken, or the stools may merely be discarded, remelted and recast.

I claim:

1. A cast iron ingot mold base member, the top portion of which contains a preformed integral refractory insert of at least 4 inches in thickness united with the cast iron ingot mold base member during the casting of said base member, and where the thickness of the ingot mold base member exceeds the thickness of the refractory insert.

2. The ingot mold base member of claim 1 wherein the refractory insert comprises a mixture containing 40–95% alumina, 5–20% binder and the remainder filler wherein said insert is of a parallel face geometric shape.

3. The ingot mold base member of claim 2 wherein the binder of the refractory insert comprises up to 50% by weight water and a compound selected from the group consisting of ethyl silicate, sodium silicate, aluminum phosphate, colloidal silica and clay.

4. The ingot mold base member of claim 2 wherein the refractory insert contains at least 70% of alumina.

5. The ingot mold base member of claim 2 wherein the refractory insert contains mortise-like openings in its side.

6. A cast iron ingot mold base member, the top portion of which contains a preformed alumina-containing integral refractory insert of at least 4 inches in thickness united with the cast iron ingot mold base member during the casting of said base member, and where the thickness of the ingot mold base member exceeds the thickness of the refractory insert.

* * * * *